United States Patent [19]

Heitmann

[11] Patent Number: 4,564,027

[45] Date of Patent: Jan. 14, 1986

[54] APPARATUS FOR BUILDING A CONTINUOUS TOBACCO STREAM

[75] Inventor: Uwe Heitmann, Hamburg, Fed. Rep. of Germany

[73] Assignee: Hauni-Werke Körber & Co. KG, Hamburg, Fed. Rep. of Germany

[21] Appl. No.: 557,732

[22] Filed: Dec. 2, 1983

[30] Foreign Application Priority Data

Dec. 2, 1982 [DE] Fed. Rep. of Germany ..... 3244534

[51] Int. Cl.[4] ..... A24C 5/18; A24C 5/39

[52] U.S. Cl. ..... 131/84.3; 131/108; 131/110; 131/109.2

[58] Field of Search ..... 131/84 B, 108, 109 R, 131/109 B, 109 AB, 66 R, 909, 110

[56] References Cited

U.S. PATENT DOCUMENTS 4,175,570 11/1979 Heitmann ..... 131/84 B
4,185,644 1/1980 Heitmann et al. ..... 131/109 R
4,235,248 11/1980 Schumacher ..... 131/108
4,373,538 2/1983 Steiniger ..... 131/109 R
4,463,768 8/1984 Quarella ..... 131/84 B
4,484,589 11/1984 Steiniger et al. ..... 131/110

*Primary Examiner*—Vincent Millin
*Assistant Examiner*—Harry Macey
*Attorney, Agent, or Firm*—Peter K. Kontler

[57] ABSTRACT

Apparatus for building a continuous tobacco stream at one side of an air-permeable conveyor, the other side of which is adjacent to a suction chamber, has two sidewalls which define with the one side of the conveyor a tobacco channel receiving tobacco particles along the concave side of a third wall which can merge into one of the sidewalls and is provided with inclined passages for the flow of compressed air in directions having components in the direction of travel of the tobacco stream. This ensures that all or nearly all particles of tobacco are accelerated in the direction of travel of the stream even before they enter the channel on their way toward the one side of the air-permeable conveyor.

20 Claims, 13 Drawing Figures

Fig.2
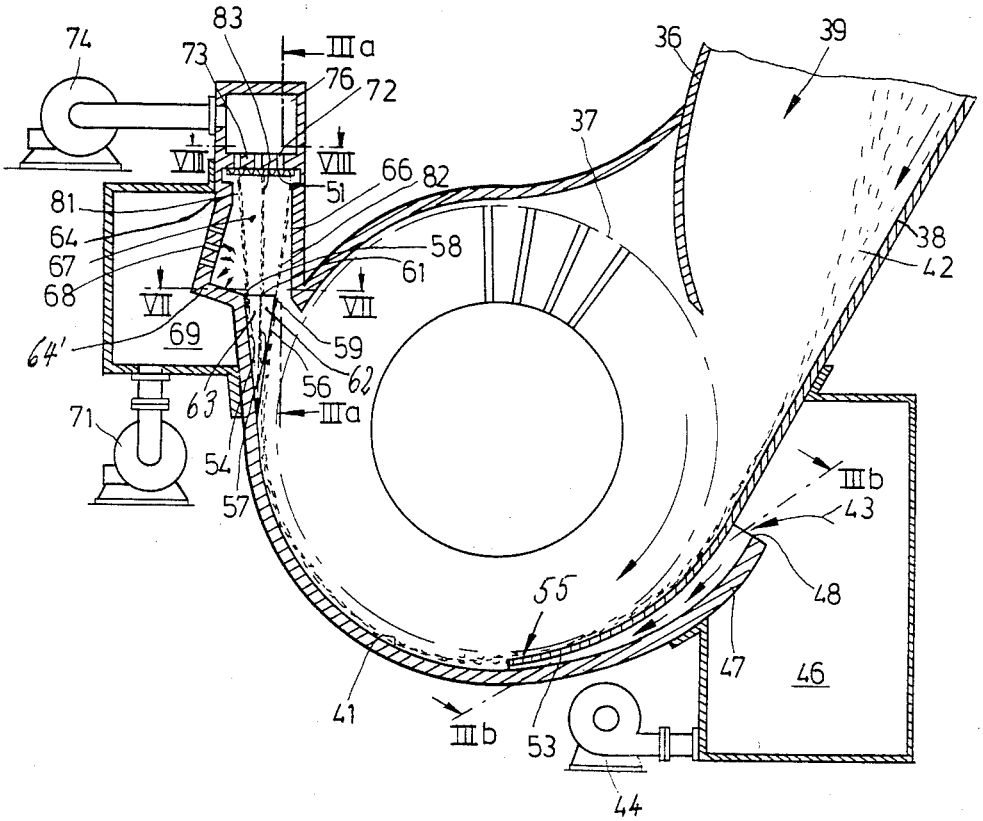
Fig.3a
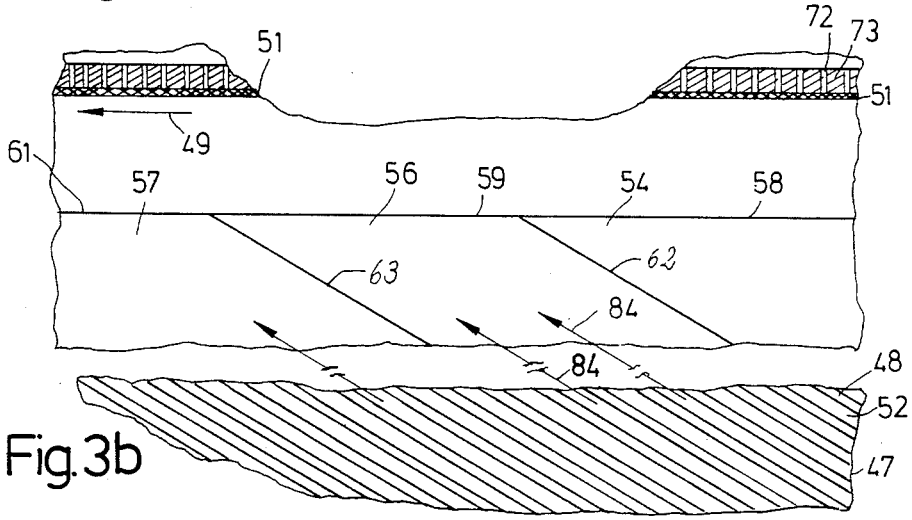
Fig.3b

Fig.4
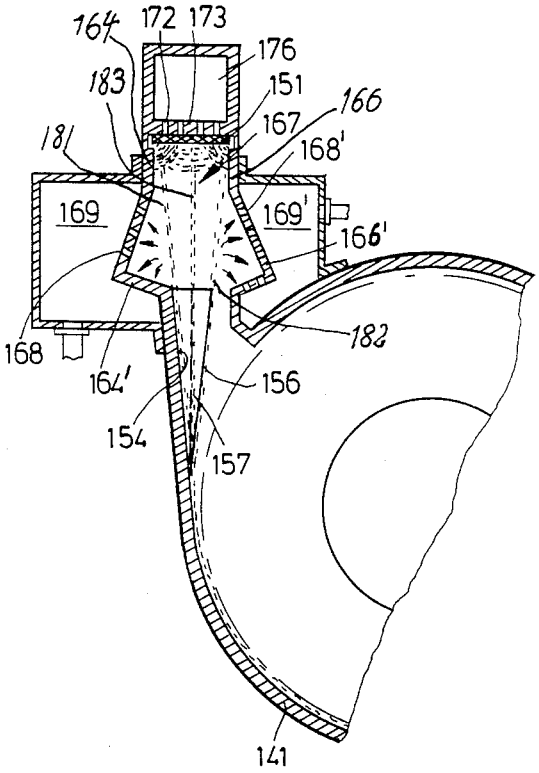
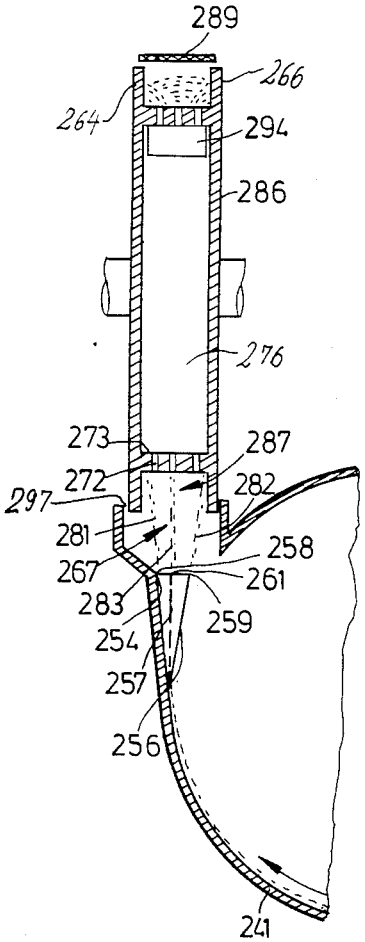
Fig.6

APPARATUS FOR BUILDING A CONTINUOUS TOBACCO STREAM

CROSS-REFERENCE TO RELATED CASES

The apparatus which is disclosed in the present application is identical with those disclosed in the commonly owned copending application Ser. No. 557,641 filed Dec. 2, 1983 by Uwe Heitmann and in the commonly owned copending application Ser. No. 557,733 filed Dec. 2, 1983 by Günter Wahle et al. Furthermore, the apparatus of the present invention is in part similar to the apparatus disclosed in the commonly owned copending application Ser. No. 557,735 filed Dec. 2, 1983 by Günter Wahle et al. and in the commonly owned copending application Ser. No. 392,775 filed June 28, 1982 by Guido Quarella, now U.S. Pat. No. 4,463,768 granted Aug. 7, 1984.

BACKGROUND OF THE INVENTION

The present invention relates to apparatus for building a continuous tobacco stream, particularly a stream which can be converted into a filler suitable for draping into a web of cigarette paper so as to form with the web a continuous rod which is thereupon subdivided into smokers' articles of desired length. More particularly, the invention relates to improvements in distributors which can be used in cigarette rod making machines to convert a mass of tobacco shreds and/or otherwise configurated tobacco particles into a continuous stream which is ready for draping or is ready to be advanced past one or more trimming or equalizing devices.

It is already known to form a continuous tobacco stream in an elongated channel which is defined by two sidewalls and an endless air-permeable tobacco transporting conveyor one side of which faces the channel and the other side of which is adjacent to a suction chamber serving to attract tobacco particles to the one side of the conveyor. The channel can receive particles of tobacco from a classifying device which segregates unsatisfactory particles from acceptable particles, and some of the particles which are admitted into the channel are often subjected to the action of air streams having components of movement in the direction of advancement of the tobacco stream with the conveyor. It is also known to admit particles of tobacco into the channel along an arcuate guide wall so that the particles enter the channel at a locus which is remote from the conveyor and travel across the channel toward the one side of the conveyor where they form a growing tobacco stream.

The provision of means for directing into the channel several air streams, which impart to certain particles of tobacco a component of movement in the direction of advancement of the growing tobacco stream, is desirable and advantageous because this contributes to homogeneousness of the tobacco stream. An ideal situation would develop if the particles of tobacco could be accelerated and oriented in such a way that no relative movement or minimal relative movement would take place between the conveyor and the particles which are in the process of accumulating thereon. Heretofore known apparatus are incapable of bringing about uniform, predictable and optimum acceleration and orientation of all tobacco particles before the particles reach the conveyor. The situation is close to ideal in a certain portion of the channel if the apparatus is constructed and assembled in a manner as disclosed in commonly owned U.S. Pat. No. 4,175,570 granted Nov. 27, 1979 to Uwe Heitmann. The patented apparatus is capable of ensuring highly satisfactory acceleration of tobacco particles adjacent to one sidewall by providing such sidewall with air guiding channels serving to admit streams of compressed air which propel the particles that are close to the one sidewall in a direction such that the extent of relative movement between the conveyor and the particles which were acted upon by the air streams is negligible or nearly zero. The air guiding channels are rather closely adjacent to the one side of the conveyor so that air streams which are conveyed therealong cannot influence each and every tobacco particle to an optimum extent.

OBJECTS AND SUMMARY OF THE INVENTION

An object of the invention is to provide an apparatus which can build a continuous tobacco stream exhibiting a more satisfactory homogeneousness than the tobacco streams which are formed in heretofore known apparatus.

Another object of the invention is to provide a novel and improved distributor for use in cigarette rod making and analogous machines.

A further object of the invention is to provide a novel and improved method of influencing particles of tobacco on their way toward the stream building zone in the distributor of a cigarette rod making or like machine.

An additional object of the invention is to provide an apparatus which can uniformly influence the velocity as well as the direction of movement of all, or practically all, particles of tobacco which are on their way toward the stream building zone of a distributor in a cigarette rod making or like machine.

Still another object of the invention is to provide the apparatus with novel and improved means for feeding particles of tobacco into the channel which is defined by two sidewalls and an endless conveyor in the distributor of a cigarette rod maker.

Another object of the invention is to provide novel and improved means for controlling the direction of flow of air which is used to influence the acceleration and the direction of movement of tobacco particles in the region immediately ahead of the stream building zone.

A further object of the invention is to provide an apparatus which can be installed in existing cigarette rod makers and like machines as a superior substitute for heretofore known tobacco stream forming apparatus.

An additional object of the invention is to provide the apparatus with novel and improved means for admitting particles of tobacco into the range of air streams ahead of the stream forming zone.

A further object of the invention is to provide a novel and improved stream building conveyor for use in the above outlined apparatus.

Another object of the invention is to provide an apparatus which can establish identical or practically identical conditions for the transport and acceleration of tobacco particles across the entire channel between the sidewalls which flank the stream building zone.

A further object of the invention is to provide an apparatus which can form a homogeneous tobacco stream for any desired (extended or short) period of time and whose energy requirements need not exceed those of heretofore known apparatus.

Another object of the invention is to provide the apparatus with novel and improved means for treating particles of tobacco ahead of the channel which defines or contains the stream building zone.

A further object of the invention is to provide an apparatus which is capable of forming a highly homogeneous tobacco stream at the rate which is required in modern high-speed cigarette makers.

The invention is embodied in an apparatus for building a continuous tobacco stream in the distributor of a filler forming machine, e.g., in the distributor of a cigarette rod making machine wherein the filler constitutes the tobacco-containing portion of a continuous cigarette rod which is thereupon subdivided into sections of desired length. The improved apparatus comprises a conveyor including an air-permeable tobacco advancing element which is driven to move in a predetermined direction, suction generating means adjacent to the first side of the air-permeable element, first and second sidewalls adjacent to the second side of and defining with the air-permeable element an elongated channel extending in the predetermined direction, a source of tobacco particles (such source can constitute or form part of a tobacco classifying device wherein satisfactory particles of tobacco, particularly shreds, are segregated from unsatisfactory particles including heavy fragments of ribs and the like), a source of compressed air, and means for feeding tobacco particles to the conveyor. The feeding means comprises means for supplying particles of tobacco from the respective source along an arcuate path and into the channel so that the particles advance toward and adhere to the second side of the air-permeable element under the action of the suction generating means at the first side of the air-permeable element, and means for admitting into the arcuate path several streams of compressed air from the respective source so that each such stream is inclined with reference to and has a component of movement in the predetermined direction to thus compel the particles of tobacco in the channel to advance toward the second side of the air-permeable element while simultaneously advancing in the predetermined direction before the particles reach the air-permeable element. The supplying means of the feeding means can comprise a third wall which is adjacent to the arcuate path and merges gradually into one of the sidewalls at a location which is remote from the air-permeable element. The source of compressed air can comprise a plenum chamber and a blower whose pressure side is connected to the plenum chamber.

The outlet portion of the arcuate path communicates with and the inlet portion of such path is remote from the channel, and the admitting means can comprise a nozzle which serves to admit compressed air into the inlet portion of the arcuate path so that the streams of compressed air can act upon the particles of tobacco at least substantially along the entire arcuate path. The admitting means can further comprise vanes or partitions which subdivide the interior of the nozzle into a plurality of passages each of which is inclined with reference to the predetermined direction and each of which serves to convey a stream of compressed air from the plenum chamber into the arcuate path. The nozzle preferably further comprises an arcuate cover whose curvature substantially matches that of the arcuate path and which overlies the passages in the nozzle. The convex side of the cover faces the passages and the concave side of the cover can constitute a chute serving to direct tobacco particles from the source into the arcuate path.

The supplying means can comprise a plurality of edge faces which are disposed at its outlet portion and are spaced apart from the second side of the air-permeable element. Thus, the particles of tobacco must advance beyond the edge faces of the supplying means and toward the second side of the air-permeable element, and such edge faces are preferably staggered relative to each other, as considered transversely of the predetermined direction. The supplying means preferably further comprises a guide face for each of the edge faces and each guide face extends toward and terminates at the respective edge face. The second side of the air-permeable element has first and second marginal portions, each of which is adjacent to a different one of the two sidewalls, and a central portion between the two marginal portions; the orientation of the guide faces is preferably such that two thereof respectively direct tobacco particles toward the first and second marginal portions and a third thereof directs tobacco particles toward the central portion of the second side of the air-permeable element of the conveyor.

The supplying means preferably further comprises a guide surface between each pair of neighboring guide faces, and each such guide surface is inclined with reference to the predetermined direction through an angle which at least approximates the angle of inclination of the streams of compressed air with reference to such direction.

At least one of the sidewalls can comprise an air-permeable portion or section which is disposed between the edge faces of the supplying means and the second side of the air-permeable element to permit some air to escape from the channel by way of the air-permeable section of the one sidewall rather than exclusively through the air-permeable element. The air-permeable section of the one sidewall is spaced apart from the edge faces of the supplying means, as considered transversely of the predetermined direction, so that air which passes through the air-permeable section undergoes a pronounced change in the direction of flow; this ensures that the particles of tobacco continue to advance by inertia toward the second side of the air-permeable element and do not clog the pores, holes, interstices or otherwise configurated openings in the air-permeable section of the one sidewall. A suction generating device is preferably adjacent to the outer side of the air-permeable section of the one sidewall to draw air from the channel and to thus reduce the quantity of air that leaves the channel through the air-permeable element under the action of the suction generating means at the first side of such element. The suction generating device at the outer side of the air-permeable section of the one sidewall can comprise a suction chamber which communicates with the channel by way of the air-permeable section and a blower whose suction side is connected to the suction chamber.

The conveyor can include an endless band having an elongated reach which constitutes the air-permeable element. Alternatively, the conveyor can comprise a rotary disc having a circumferentially extending wall which constitutes the air-permeable element. Such apparatus can further comprise a second conveyor including an endless air-permeable band with an elongated reach the first side of which is adjacent to a portion of the air-permeable element and the second side of which is adjacent to a suction chamber which draws tobacco particles from the second side of the air-permeable element.

The channel can be disposed at a level below the air-permeable element, and the distance between the second side of such element and the outlet of the arcuate path can be a relatively small or a very small fraction of the distance between the inlet and the outlet of the arcuate path. The air-permeable element or a part which is closely adjacent thereto can include sections which exhibit different permeabilities; this reduces the consumption of air because, once the particles of tobacco adhere to the second side of the air-permeable element to form a portion of a growing tobacco stream thereon, they can be properly retained by the application of a force which barely suffices to ensure that the configuration of the stream does not undergo undesirable changes prior to arriving into the range of the trimming device or devices which convert the stream into a filler by removing the surplus of tobacco particles therefrom.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged vertical sectional view of a detail in the distributor of FIG. 1, showing the means for feeding tobacco particles into the channel adjacent to the air-permeable element of the tobacco stream forming and transporting conveyor;

FIG. 3*a* is an enlarged fragmentary transverse vertical sectional view as seen in the direction of arrows from the line III*a*—III*a* of FIG. 2;

FIG. 3*b* is an enlarged fragmentary elevational view as seen in the direction of arrows from the line III-*b*—III*b* of FIG. 2;

FIG. 4 is a fragmentary vertical sectional view similar to that of FIG. 2 but showing a portion of a modified distributor;

FIG. 6 is a fragmentary transverse vertical sectional view as seen in the direction of arrows from the line VI—VI of FIG. 5*a;*

DESCRIPTION OF THE PREF ERRED EMBODIMENTS

Figure 1:
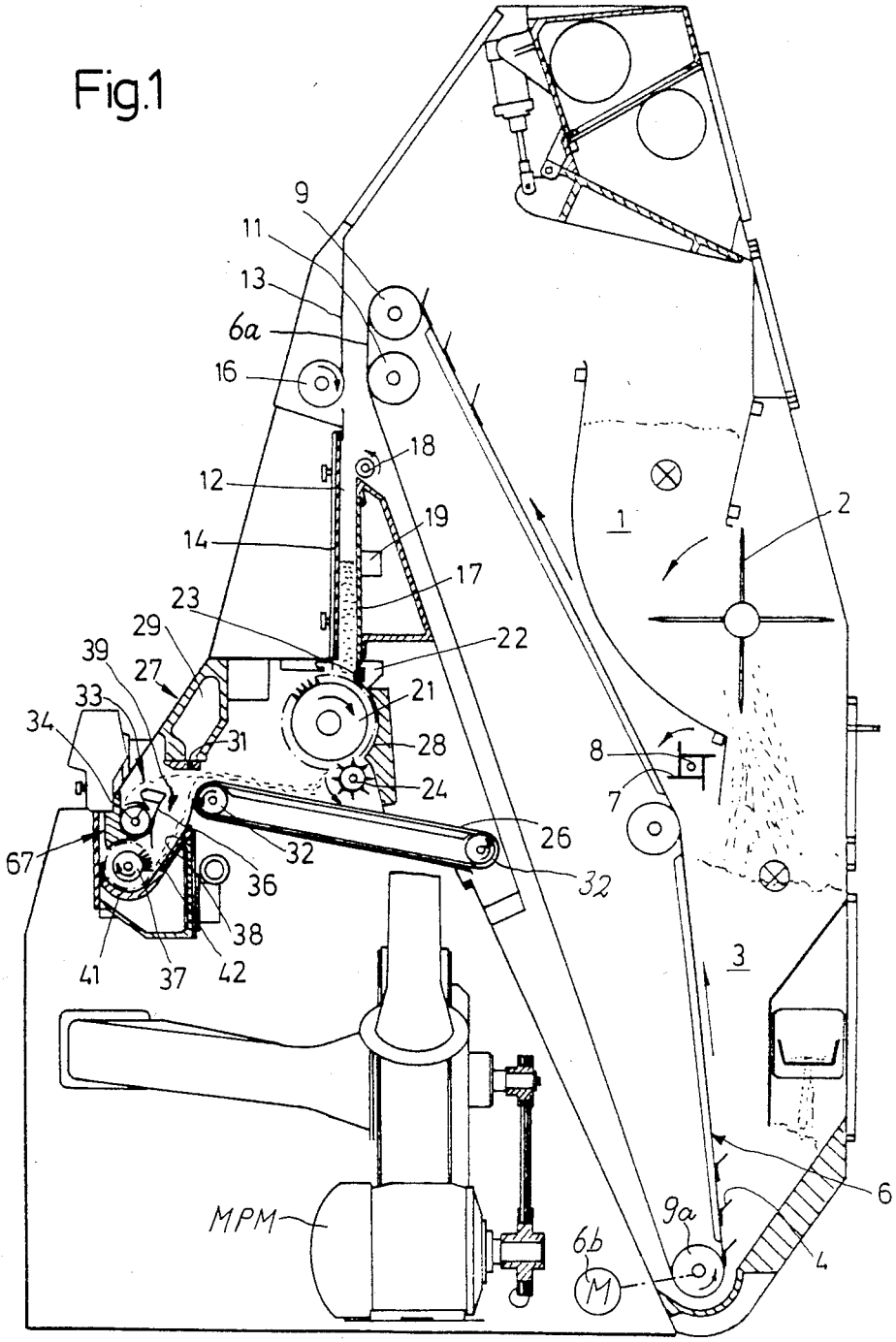
FIG. 1 is a side elevational view of a distributor which forms part of a cigarette rod making machine and embodies one form of the invention, the front sidewall of the frame of the cigarette rod making machine being omitted and certain parts being shown in a vertical sectional view.

FIG. 1 shows a distributor which comprises a main magazine 1 containing a rather substantial supply of tobacco particles (normally including mainly tobacco shreds, some short tobacco, some fragments of tobacco ribs and possibly a few pieces of metal). A rotary rake 2 is provided to transfer tobacco from the main magazine 1 into a smaller second magazine 3 which has an open side adjacent to the upwardly moving reach of a steep endless belt conveyor 6. The conveyor 6 has equidistant external entraining elements 4 which define pockets serving to draw batches of tobacco particles from the supply in the second magazine 3, and each such batch is equalized by a driven paddle wheel 8 having flexible vanes or paddles 7 (e.g., in the form of leather straps) which brush off the surplus from successive batches while the entraining elements 4 advance toward a pulley 9 at the upper end of the conveyor 6. The pulley 9 is rather closely adjacent to and is disposed at a level above a deflecting roller 11 which ensures that the uppermost portion 6*a* of the left-hand reach of the conveyor 6 is vertical or nearly vertical, namely, that the portion 6*a* is at least substantially parallel to an upright guide wall 13 constituting an upward extension of the left-hand or front sidewall 14 of an upright duct 12. The guide wall 13 has an opening for a portion of a driven magnetic roller 16 serving to attract particles of metallic material, if any, which might be present in the batches of tobacco that are dumped by successive entraining elements 4 subsequent to travel around the pulley 9. The top portion of the right-hand or rear sidewall 17 of the duct 12 carries a driven roller 18 which is rotated at a constant speed and prevents shreds or other particles of tobacco from accumulating on top of the sidewall 17. The portion 6*a* of the left-hand reach of the conveyor 6 cooperates with the guide wall 13 and with the driven roller 18 to ensure that all particles of tobacco which are dumped by successive entraining elements 4 find their way into the duct 12.

The rear sidewall 17 of the duct 12 carries a monitoring device 19 which preferably includes a battery of reflection type photocells (not specifically shown). The photocells are staggered, as considered in as well as at right angles to the plane of FIG. 1, and generate signals denoting the levels of the corresponding portions of the column of tobacco particles in the duct 12. The photocells are electrically connected to each other and transmit signals when they are disposed at levels below the adjacent portions of the tobacco column in the duct 12 for preselected intervals of time. The signals are transmitted via suitable time-delay elements and serve to control the operation of a variable-speed motor 6*b* for the lower pulley 9*a* of the conveyor 6. This ensures that the level of the top surface of the column of tobacco particles in the duct 12 is constant or fluctuates only slightly within a rather narrow range. Reference may be had, for example, to commonly owned U.S. Pat. No. 4,223,845 granted Sept. 23, 1980 to Fritz Selonke et al.

and particularly to commonly owned U.S. Pat. No. 4,235,248 granted Nov. 25, 1980 to Peter Schumacher.

The discharge end of the duct 12 is located at the one o'clock position of a rotary carded conveyor in the form of a drum 21 which is driven at a variable speed by the main prime mover MPM of the rod making machine through the medium of a suitable transmission, not shown. The carding of the drum 21 is filled with tobacco particles during travel below the open lower end of the duct 12, and the uniformity of such filling is enhanced by a reciprocable homogenizing element 22 which is installed below the lower end portion of the sidewall 17 and has a profiled projection 23 extending into the pile of tobacco particles in the lower portion of the duct 12. The manner in which the homogenizing element 22 can enhance the penetration of tobacco particles into and uniform distribution of such particles in the carding of the drum 21 is fully disclosed in commonly owned U.S. Pat. Nos. 3,996,943 and 3,996,944 granted Dec. 14, 1976 to Alfred Hinzmann. The homogenizing element 22 is a bar or strip which is caused to oscillate in directions substantially at right angles to the plane of FIG. 1 and at a frequency which varies with the speed of the carded drum 21.

A rapidly driven rotary picker roller 24 is adjacent to the carding at the five o'clock position of the drum 21 and serves to expel the particles of tobacco from the carding so that the expelled particles accumulate on the upper reach of an upwardly sloping endless apron conveyor 26 and form thereon a layer or carpet which is transported toward, and successive increments of which are propelled into, a classifying device 27. The directions in which the carded drum 21 and the picker roller 24 rotate are indicated by arrows. The picker roller 24 is driven at a constant speed and is partially surrounded by a stationary shroud 28 which further partially surrounds the drum 21 and extends from the homogenizing element 22 all the way to the upper reach of the apron conveyor 26. The purpose of the shroud 28 is to prevent escape of tobacco particles from the carding of the drum 21 on their way from the outlet of the duct 12 toward the picker roller 24 as well as to prevent propulsion of tobacco particles (by the needles or pins of the picker roller 24) in a direction to the right, as viewed in FIG. 1, and beyond the rear end portion of the upper reach of the apron conveyor 26. The front pulley 32 for the apron conveyor 26 is driven at a constant speed by a suitable motor, not shown, e.g., by the motor which also drives the picker roller 24. The external surface of the apron conveyor 26 is preferably profiled and preferably constitutes the exposed side of a layer consisting of rubber or another elastomeric material which is capable of enhancing friction so as to ensure that tobacco particles which form the aforementioned carpet advance toward the left-hand pulley 32 at least substantially without slippage.

The classifying device 27 comprises a plenum chamber 29 having a bottom portion provided with a horizontal row of square or rectangular openings 31 serving to direct jets of compressed air downwardly in front of the apron conveyor 26. Such jets form a curtain which can deflect lightweight particles of tobacco but does not appreciably influence (alter) the trajectories of heavier particles which thus traverse the curtain and accumulate in a collecting receptacle 33. The bottom portion of the receptacle 33 surrounds a rotary feed screw 34 which serves to evacuate the heavier particles (particularly fragments of tobacco ribs) from the classifying device 27, either continuously or at regular or irregular intervals. The openings 31 are closely adjacent to each other so that the curtain of air is practically uninterrupted and thus reduces the likelihood of propulsion of satisfactory tobacco particles into the receptacle 33. The classifying device 27 further comprises a vertically adjustable barrier 36 which can be moved to any one of a number of different levels to select the quantity and weight of particles which are permitted to enter the receptacle 33. Thus, if the barrier 36 is moved to a higher level, the particles which are partially deflected by the air curtain are prevented from entering the receptacle 33 because they impinge upon the concave right-hand side of the barrier. Inversely, when the barrier 36 is moved to a lower level, it allows the heaviest as well as less heavy particles to enter the receptacle 33. The concave right-hand side of the barrier 36 directs the intercepted particles of tobacco (especially shreds) downwardly and into a duct 39 which gathers a tobacco stream 42 (see also FIG. 2) that slides along the inner side of a downwardly sloping wall 38. The latter causes successive increments of the stream 42 to enter the range of radially outwardly extending pins or needles at the periphery of a rotary carded conveyor 37 which is driven in a clockwise direction, as viewed in FIG. 1 or 2, and at a constant speed by a suitable prime mover, e.g., the aforementioned prime mover which drives the picker roller 24 and the apron conveyor 26. The duct 39 is defined by the barrier 36, by the wall 38 and by the carded conveyor 37, and the purpose of this duct is to receive and control the direction of advancement of all tobacco particles which are incapable of penetrating the air curtain and entering the receptacle 33 of the classifying device 27.

The lower portion of the wall 38 overlies a portion of an arcuate guide wall 41 whose concave upper side faces the adjacent lower portion of the carded conveyor 37 and which constitutes a means for supplying tobacco particles into an elongated tobacco channel 67. The concave side of the guide wall 41 is spaced apart from the tips of adjacent pins of the carded conveyor 37 to provide room for advancement of tobacco particles toward and into the lower portion of the channel 67 as well as for influencing of such particles during travel from the inlet toward the outlet of the arcuate path which is defined by the guide wall 41. The curvature of the concave side of the guide wall 41 preferably equals or approximates the curvature of the periphery of the carded conveyor 37.

The inlet of the arcuate path which is defined by the guide wall 41 (namely, the region where successive increments of a stream 42 of tobacco particles leave the wall 38 and duct 39 and descend onto the wall 41) is adjacent to an air admitting device which serves to admit several streams of compressed air (note the arrow 43) into the funnel-shaped gap between the rearmost portion 47 of the guide wall 41 and the lowermost portion 53 of the wall 38. Compressed air issues from a plenum chamber 46 which is connected to the pressure side of a blower 44. The reference character 48 denotes in FIG. 2 one of several partitions which are provided at the concave inner side of the guide wall 41 and serve to impart to the respective air streams a component of movement in the direction (arrow 49 in FIG. 3*a*) of advancement of the lower reach (air-permeable element) of an endless band-like tobacco stream transporting conveyor 51. The lower reach of the conveyor 51 constitutes the upper boundary of the aforementioned tobacco channel 67 which is flanked by two spaced-apart parallel upright sidewalls 64 and 66 of the distributor. The channel 67 is disposed at a level below the lower reach of the conveyor 51, and the upper side of such lower reach is adjacent to a stationary suction chamber 76 having a bottom wall 73 with openings 72 which permit air to flow from the channel 67 into the suction chamber 76.

The partitions or vanes 48 at the concave side of the guide wall 41 are elongated ribs (see FIG. 3*b*) which define between themselves a plurality of relatively narrow passages 52 for the flow of streams of compressed air from the plenum chamber 46 into the arcuate path at the concave side of the guide wall 41 below the carded conveyor 37. The direction of flow of such streams of compressed air is indicated by arrows 84, and it will be noted that each air stream has a component of movement in the direction (arrow 49) in which the underside of the lower reach of the conveyor 51 advances the growing and the fully grown tobacco stream within and from the channel 67.

The lowermost portion 53 of the downwardly sloping wall 38 of the duct 39 constitutes a cover which is spaced apart from and overlies the passages 52 between the partitions 48 of the guide wall 41, and the concave upper side of the cover 53 guides successive increments of the tobacco stream 42 into the body of compressed air which together forms the streams flowing in and beyond the passages 52. The parts 47, 48 and 53 can be said to constitute an air admitting nozzle 55 whose interior is subdivided into the aforementioned passages 52 by the partitions 48 and which directs the streams of compressed air in the directions indicated by the arrows 84 to thereby control the acceleration as well as the direction of movement of tobacco particles which form the stream 42 and enter the space between the lower portion of the carded conveyor 37 and the non-overlapped portion of the arcuate guide wall 41.

The outlet of the path which is defined by the concave upper side of the guide wall 41 terminates at three edge faces 58, 59, 61 of the guide wall 41. Such edge faces are spaced apart from the underside of the lower reach of the conveyor 51 and are staggered with reference to each other, as considered transversely of the direction which is indicated by the arrow 49. The edge faces 58, 59, 61 are respectively disposed at the discharge ends of three guide faces 54, 56, 57 which are defined by the outlet portion of the guide wall 41 at a level below the channel 67 and along which three discrete partial streams 81, 82, 83 of tobacco particles advance in the directions indicated by the arrows 84, i.e., each with a component of movement in the direction of arrow 49. Tobacco particles and streams of compressed air which flow along the guide faces 54, 56, 57 are caused to advance beyond the respective edge faces 58, 59, 61 and toward the underside of the lower reach of the conveyor 51. The orientation of the guide faces 54, 56, 57 with reference to the underside of the lower reach of the conveyor 51 is such that imaginary lines extending therealong and being tangential to the guide wall 41 point toward different portions of the underside of the aforementioned lower reach. Thus, the guide face 54 of the guide wall 41 directs the partial stream 81 of tobacco particles against the left-hand marginal portion of the lower reach of the conveyor 51, as viewed in FIG. 2 (close to the sidewall 64), the guide face 57 directs the partial stream 82 of tobacco particles against the right-hand marginal portion of the underside of the lower reach (close to the sidewall 66), and the guide face 56 directs the partial stream 83 of tobacco particles against the median or central portion of the underside of the lower reach of the conveyor 51. In the embodiment of FIG. 2, the guide faces 54, 56, 57 are flat or substantially flat and their edge faces 58, 59, 61 are equidistant from the underside of the lower reach of the conveyor 51.

The guide faces 54, 56 are separated from each other by an additional surface 62 of the guide wall 41, and the guide faces 56, 57 are separated from one another by an additional surface 63. The inclination of additional surfaces 62 and 63 is the same as that of the air streams which carry the particles of tobacco into the channel 67, i.e., beyond the edge faces 58, 59 and 61. Such inclination of the additional surfaces 62, 63 ensures that the partial tobacco streams 81, 82 and 83, which are propelled beyond the respective edge faces 58, 61, 59 of the guide wall 41, cannot interfere with each other during travel in the channel 67 and toward the lower reach of the conveyor 51.

The sidewall 64, which bounds the left-hand side of the channel 67 in FIG. 2, has an air-permeable portion or section 64' which slopes downwardly and outwardly in a direction away from the other sidewall 66 and has openings 68 which establish communication between the channel 67 and a suction chamber 69 which is outwardly adjacent to the portion 64' of the sidewall 64 and is connected to the suction intake of a blower 71. The portion 64' merges into the lowermost portion of the sidewall 64 at the general level of the edge faces 58, 59, 61 and the lower portion of the sidewall 64 merges gradually into the guide wall 41. The lower part of the air-permeable portion 64' defines a pronounced ledge at the level of the edge faces 58, 59, 61 and the openings 68 are spaced apart from the nearest partial stream 81 of tobacco particles. Such configuration of the air-permeable portion 64' ensures that the suction chamber 69 can draw some (surplus) air from the channel 67 but that the streams of air passing through the openings 68 are not likely to entrain particles of tobacco whose inertia should be sufficient to ensure that they remain in the streams 81, 82, 83 and to continue their movement in the channel 67 toward the underside of the lower reach of the conveyor 51. This ensures that the openings 68 are not likely to be clogged with particles of tobacco, i.e., that the suction chamber 69 is free to draw from the channel 67 all such air which is not or cannot be caused to pass through the interstices of the lower reach of the conveyor 51, through the openings 72 in the bottom wall 73 and into the suction chamber 76. The latter is connected to the suction intake of a blower 74.

Figure 8:
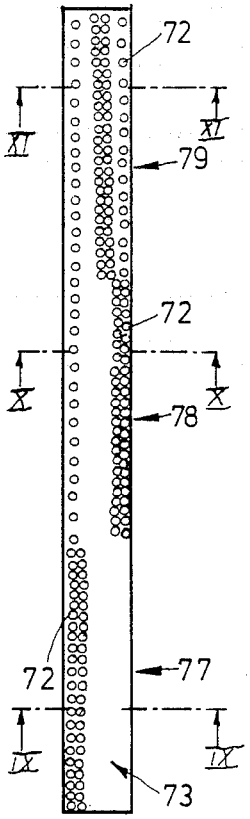
FIG. 8 is a plan view of the bottom wall of a suction chamber in the distributor of FIG. 1, substantially as seen in the direction of arrows from the line VIII—VIII of FIG. 2.

FIG. 8 shows one presently preferred distribution of openings 72 (e.g., circular holes) in the bottom wall 73 of the suction chamber 76. The section 77 of the bottom wall 73 has two rows of openings 72 which are adjacent to the sidewall 64 and serve to attract the particles of the partial stream 81. The next section 78 of the bottom wall 73 (as considered in the direction (arrow 49) of advancement of tobacco particles with the conveyor 51) has two rows of openings 72 adjacent to the sidewall 66 to attract the particles of the partial stream 82 and a single row of openings 72 adjacent to the sidewall 64 to hold the particles of the partial stream 82. The third section 79 of the bottom wall 73 has two centrally located rows of openings 72 to attract the particles of the partial tobacco stream 83 and two additional rows of openings 72 which are adjacent to the sidewalls 64 and 66 and serve to hold the corresponding particles of tobacco (previously the particles of the partial streams 81, 82) at the underside of the lower reach of the conveyor 51. Thus, the partial streams 81, 82, 83 are attracted with greater force to the respective portions or sections of the lower reach of the conveyor 51 while their particles are still in the process of travelling upwardly through the channel 67, and the particles which have come to rest at the underside of the lower reach of the conveyor 51 are attracted with lesser force which should suffice to ensure that the particles share the movement of the conveyor 51 in the direction which is indicated by the arrow 49.

The mode of operation of the distributor which embodies the structure of FIGS. 1, 2, 3*a*, 3*b* and 7 to 11 is as follows:

The entraining elements 4 of the conveyor 6 draw relatively small batches of tobacco particles from the second magazine 3 and the quantity of tobacco in each batch matches or approximates the quantity of tobacco in the preceding batch after a batch advances beyond the paddle wheel 8 whose flexible paddles or vanes 7 remove the surplus and return the removed material into the magazine 3. Successive equalized batches are dumped during travel around the pulley 9 and descend between the portion 6*a* of the left-hand reach of the conveyor 6 and the guide wall 13 to enter the duct 12 wherein they form a column of tobacco particles. Any particles of metal which might be present in the dumped equalized batches are extracted by the rotating magnetic roller 16. The device 19 monitors the height of the column of tobacco in the duct 12, and its signals regulate the operation of the motor 6*b* for the lower pulley 9*a* of the conveyor 6 so that the speed of the conveyor 6 increases when the level of the top surface of the tobacco column in the duct 12 descends below an acceptable minimum level but the speed of the conveyor 6 is increased when the level of the top surface of the column of tobacco rises above the maximum acceptable level. The arrangement is or can be such that the motor 6*b* varies the speed of the conveyor 6 in stepwise fashion.

The rotating carded drum 21 draws particles of tobacco from the lower end of the duct 12 and its carding is uniformly filled with tobacco particles by the continuously oscillating homogenizing element 22. At the same time, the upwardly extending profiled projection 23 of the homogenizing element 22 loosens the material in the lower portion of the column of tobacco in the duct 12 to ensure predictable advancement of loosened particles into the range of the carding on the drum 21.

The upper part of the shroud 28 prevents escape of tobacco particles from the carding of the drum 21 on their way from the discharge end of the duct 12 toward the picker roller 24, and the lower part of this shroud prevents the picker roller 24 from propelling particles of tobacco rearwardly and beyond the right-hand pulley 32 for the apron conveyor 26, as viewed in FIG. 1. If desired, that portion of the shroud 28 which is adjacent to the picker roller 24 can constitute or resemble a comb whose prongs alternate with the pins of the picker roller, as considered at right angles to the plane of FIG. 1. The particles of tobacco which are expelled from the carding of the drum 21 by the pins of the picker roller 24 descend onto and form on the continuously running apron conveyor 26 a relatively wide carpet whose increments advance toward and beyond the left-hand pulley 32. As a rule, longer shreds of tobacco are held by the pins of the picker roller 24 somewhat longer than the shorter shreds; this is desirable and advantageous for the classifying action of the device 27. Thus, the longer shreds are deposited on the upper reach of the apron conveyor 26 nearer to the right-hand pulley 32 than the shorter shreds and other particles so that such shorter shreds and other particles come to rest on the longer shreds and the longer shreds do not interfere with propulsion of shorter shreds and other particles beyond the left-hand end turn of the conveyor 26.

The apron conveyor 26 transports the carpet of tobacco particles thereon at a constant speed, and successive increments of such carpet are propelled toward the curtain of air issuing from the openings 31 in the bottom portion of the plenum chamber 29. The inertia of heavier particles (such as fragments of ribs which would be likely to puncture the wrapping material for a tobacco filler) suffices to ensure that the deflection of such particles by the downwardly flowing jets of air, which form the aforementioned curtain below the openings 31, is zero or insufficient to prevent the heavier particles from entering the collecting receptacle 33 and descending into the range of the feed screw 34. The feature that the longer shreds are located in the lower portion of the tobacco carpet on the upper reach of the apron conveyor 26 ensures that the longer shreds cannot interfere with the propulsion of heavier tobacco particles (on top of the shreds) across the curtain of air, and the trajectories of the heavier particles are such that all heavier particles enter the receptacle 33. All other particles of the carpet are deflected by the curtain of air to a greater or lesser extent but sufficiently to descend directly into the duct 39 or to impinge upon the concave right-hand side of the vertically adjustable barrier 36 which causes the impinging particles to slide therealong and to descend into the duct 39, i.e., onto the downwardly sloping upper side of the wall 38 in the region where the plenum chamber 46 admits compressed air into the passages 52 of the nozzle 55. The leader of the tobacco stream 42 on the wall 38 enters the arcuate path at the concave upper side of the guide wall 41 downstream of the cover 53.

The mass of compressed air which flows from the plenum chamber 46 in the direction of arrow 43 enters the passages 52 between the partitions 48 in the interior of the nozzle 55, and such mass of air forms a substantial number of discrete streams which flow in directions indicated by the arrows 84 to meet the particles of tobacco at the downstream end of the cover 53. Each air stream in the nozzle 55 has a component of movement in the direction (arrow 49) of movement of the lower reach of the conveyor 51 above the channel 67. It will be noted that the air streams which are formed in the passages 52 of the nozzle 55 engage the particles of tobacco as soon as such particles enter the arcuate path between the non-overlapped portion of the guide wall 41 and the carded conveyor 37. The particles of tobacco are entrained in the directions indicated by the arrows 84 and form a relatively thin layer which closely hugs the concave upper side of the non-overlapped portion of the guide wall 41 during travel toward the outlet of the arcuate path, namely, toward the edge faces 58, 59 and 61 of the guide wall 41. The aforementioned path contains a mixture of tobacco particles (mainly shreds) and streams of compressed air, and the solid particles of such mixture are subdivided into three partial streams 81, 82, 83 by advancing along the guide faces 54, 56 and 57 of the guide wall 41. The guide face 54 directs successive increments of the partial stream 81 toward the left-hand marginal portion of the underside of the lower reach of the conveyor 51 i.e., toward the two rows of openings 72 in the section 77 of the bottom wall 73 of the suction chamber 76, and such increments of the partial stream 81 are propelled beyond the respective edge face 58 to traverse the channel 67 and to impinge upon the underside of the lower reach of the conveyor 51 in register with the several rows of openings 72 in the section 77 of the bottom wall 73 (see the lower part of FIG. 8 and FIG. 9). Thus, tobacco particles of the partial stream 81 form a first portion of a homogeneous tobacco stream at the underside of the lower reach of the conveyor 51, and such first portion of the homogeneous stream is adjacent to the sidewall 64.

Figure 10:
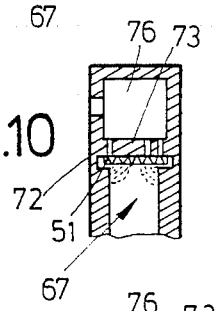
FIG. 10 is a sectional view as seen in the direction of arrows from the line X—X of FIG. 8.
Figure 9:
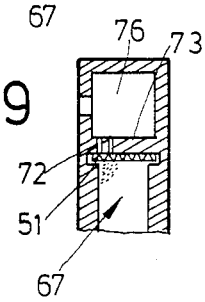
FIG. 9 is a sectional view as seen in the direction of arrows from the line IX—IX of FIG. 8.

The second partial stream 82 travels along the guide face 56 of the guide wall 41 and is propelled beyond the respective edge face 59 to advance toward and to adhere to the right-hand marginal portion of the underside of the lower reach of the conveyor 51 in the region of the two rows of openings 72 in the section 78 of the bottom wall 73 of the suction chamber 76 (see the median portion of FIG.8 and FIG. 10). The partial stream 82 thus forms a second part of the growing homogeneous tobacco stream at the underside of the lower reach of the conveyor 51, and the first part of the homogeneous tobacco stream (the particles of the partial stream 81) is held against the underside of the lower reach of the conveyor 51 by the single row of openings 72 shown in the left-hand portion of the section 78 of the bottom wall 73.

Figure 11:
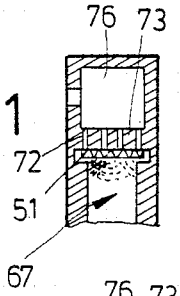
FIG. 11 is a sectional view as seen in the direction of arrows from the line XI—XI of FIG. 8.

The partial stream 83 travels along the guide face 57 and is propelled beyond the edge face 61 to advance toward and to impinge upon the central portion of the underside of the lower reach of the conyeyor 51 below the two rows of openings 72 in the section 79 of the bottom wall 73 (see FIGS. 8 and 11). This completes the formation of a homogeneous tobacco stream which overlies the entire underside of the lower reach of the conveyor 51 all the way between the sidewalls 64 and 66. All particles of tobacco which advance beyond the edge faces 58, 59, 61 have a component of movement in the direction of arrow 49 because they advance in the directions which are indicated by the arrows 84. This ensures that the extent of movement of tobacco particles relative to the conveyor 51, upon impingement of such particles on the underside of the lower reach of the conveyor 51, is negligible or nil.

The distribution of openings 72 in a manner as shown in FIGS. 8, 9, 10 and 11 is optional but highly desirable. Thus, the guide faces 54, 56, 57 could suffice to ensure predictable distribution of tobacco particles which form the streams 81, 82 and 83 at the underside of the lower reach of the conveyor 51; however, the distribution of openings 72 in a manner as shown in FIGS. 8 to 11 promotes the formation of a homogeneous tobacco stream which can be converted into a rod-like filler without trimming or with a minimum of trimming. Absence of trimming or a reduction of the extent of trimming entails a reduction of the quantity of short tobacco which develops in the distributor of a cigarette rod making or an analogous machine. The single rows of openings 72 in the sections 78 and 79 of the bottom wall 73 of the suction chamber 76 suffice to ensure adequate retention of the respective portions of the homogeneous tobacco stream on the conveyor 51 during transport of the homogeneous stream toward the trimming station or directly to the wrapping station of the rod making machine. A suitable trimming arrangement for a stream of tobacco particles (except that the stream is disposed at the upper side rather than at the underside of the conveyor) is disclosed in commonly owned U.S. Pat. No. 4,037,608 granted July 26, 1977 to Günter Wahle.

The purpose of the pins on the carded conveyor 37 is to effect further acceleration of tobacco particles which are to form the partial streams 81, 82 and 83. This conveyor constitutes an optional feature of the improved apparatus, i.e., the particles of the stream 42 can be accelerated and caused to change the direction of their travel (to advance in the directions indicated by the arrows 84) exclusively under the action of air streams which are formed in and issue from the nozzle 55.

As a rule, or at least under certain circumstances, the quantity of air which is admitted by the nozzle 55 and flows along the concave upper side of the guide wall 41 toward and into the channel 67 exceeds the quantity of air which can escape through the interstices of the lower reach of the conveyor 51, through the openings 72 of the bottom wall 73 and into the suction chamber 76. The surplus of air which is admitted by the nozzle 55 is withdrawn by the suction chamber 69 via openings 68 in the air-permeable portion 64' of the sidewall 64. As mentioned above, deflection of air which flows in the channel 67 toward the openings 68 is pronounced but the inertia of ascending tobacco particles in the channel 67 suffices to ensure that such particles remain in the channel 67 and ultimately adhere to the underside of the lower reach of the conveyor 51 rather than to the right-hand side of the air-permeable portion 64', as viewed in FIG. 2. In other words, the trajectories of tobacco particles which form the partial streams 81, 82 and 83 in the channel 67 are not altered by the streams of air which are diverted into the suction chamber 69 by way of the openings 68 in the portion 64'.

An important advantage of the improved apparatus is that all (or practically all) particles of tobacco which travel (in unsupported condition) in the channel 67 already have a component of movement in the direction of arrow 49 so that they are much more likely to form at the underside of the lower reach of the conveyor 51 a tobacco stream which is homogeneous all the way from the sidewall 64 to the sidewall 66. This is due to the fact that the particles of tobacco which form the stream 42 are subjected to the action of properly oriented air streams as soon as they advance beyond the cover 53 of the nozzle 55, i.e., as soon as they reach the non-overlapped portion of the concave upper side of the guide wall 41. This gives the air streams ample time to adequately influence all particles of tobacco and to form the three partial streams 81, 82 and 83 which are thereupon aimed upon selected portions of the underside of the lower reach of the conveyor 51 to form a tobacco stream of heretofore unmatched homogeneousness. It will be noted that the distance between the cover 53 (i.e., between the nozzle 55) and the outlet (at 57, 58, 59) of the arcuate path which is defined by the guide wall 41 greatly exceeds the distance between the edge faces 58, 59, 61 and the lower reach of the conveyor 51, i.e., the air streams flowing in the directions indicated by the arrows 84 have ample time to adequately influence all particles of tobacco which are about to advance beyond the respective edge faces of the guide wall 41. The feature that the air streams which issue from the nozzle 55 flow along the concave upper side of the guide wall 41 contributes to predictable transport of tobacco particles toward the channel 67 because the air streams closely follow the concave side of the wall 41 so that the gaseous media of such streams effect a very pronounced and desirable stabilization of the travel of tobacco particles in the directions which are indicated by arrows 84. The subdivision of the interior of the nozzle 55 into several passages 52 by suitably inclined partitions 48 and cover 53 brings about the advantage that the properly oriented streams of compressed air merge into the tobacco stream 42 substantially tangentially and the particles of tobacco are accelerated (in the directions indicated by arrows 84) practically without any turbulence in the region at the concave upper side of the guide wall 41.

The partitions 48 in the nozzle 55 ensure that each of the partial tobacco streams 81, 82, 83 has a component of movement in the direction (arrow 49) of movement of the lower reach of the conveyor 51. The means for imparting to the partial streams 81, 82 and 83 components of movements in directions toward selected portions of the underside of the lower reach of the conveyor 51 (as described in connection with FIGS. 8 to 11) includes the guide faces 54, 56, 57 as well as the additional surfaces 62 (between 54, 56) and 63 (between 56, 57). The number of guide faces at the outlet of the arcuate path for the transport of tobacco particles toward the channel 67 can be reduced to two or increased to four or more. It has been found that the provision of three guide faces (54, 56, 57) normally suffices to ensure adequate distribution of tobacco particles on all such portions of the underside of the lower reach of the conveyor 51 which are hard to reach without any special undertakings. These portions include the marginal portions which are adjacent to the respective sidewalls 64, 66 and the central portion between such marginal portions. As mentioned above, the additional surfaces 62 and 63 render it less likely that the particles of tobacco which form the partial streams 81, 82 and 83 would interfere with each other during travel (in unsupported condition) in the channel 67 and toward the conveyor 51.

It has been found that, by proper selection of the rate of flow of air into the passages 52 of the nozzle 55, by proper selection of the rate of evacuation of air from the channel 67 into the suction chamber 76, and by proper selection of the rate of air flow into the suction chamber 69, the apparatus of the present invention can produce a tobacco stream of heretofore unmatched homogeneousness. This is attributable to the establishment of initial contact between air streams and particles of tobacco well ahead of the conveyor 51 as well as to establishment of adequate contact between the streams of compressed air and all particles of tobacco which form the stream 42. Furthermore, the formation of a highly homogeneous tobacco stream is attributable to the transport of a mixture of tobacco particles and air along the arcuate path which is defined by the guide wall 41 ahead of the channel 67. As mentioned above, the accelerating and direction-determining action of the guide wall 41, in cooperation with the air streams issuing from the nozzle 55, can be so pronounced and so predictable that the carded conveyor 37 can be omitted in its entirety, i.e., the apparatus will operate properly without any mechanical tobacco accelerating means in or downstream of the source (duct 39) from which tobacco is supplied into the range of air streams in the passages 52.

FIG. 4 shows a portion of a modified apparatus wherein all such parts which are identical with or clearly analogous to the corresponding parts of the apparatus of FIGS. 1, 2, 3*a*, 3*b* and 7 to 11 are denoted by similar reference characters plus 100. The main difference between the two embodiments is that the apparatus of FIG. 4 comprises a second suction chamber 169' which is outwardly adjacent to an outwardly extending air-permeable portion or section 166' of the right-hand sidewall 166 so that the two suction chambers 169, 169' can withdraw a larger percentage of air which is supplied by the nozzle (not shown) and enters the lowermost portion of the channel 167 by flowing along the arcuate path which is defined by the concave upper side of the guide wall 141. The rate of air flow through the openings 168 and 168' of the portions or sections 164', 166' can be readily selected in such a way that the flow of some air from the channel 167 into the suction chambers 169, 169' does not influence the trajectories of particles forming the partial streams 181, 182 and even less the trajectories of particles which form the partial stream 183. The mirror symmetrical arrangement of the air-permeable portions or sections 164', 166' contributes to stabilization of the centrally located partial stream 183 as well as to stabilization of the two outer partial streams 181, 182 because air entering the suction chamber 169 is less likely to influence the particles of the partial stream 182 and air entering the suction chamber 169' is less likely to influence the particles of the partial stream 181. The actions of air streams which flow into the suction chambers 169, 169' upon the centrally located partial stream 183 of tobacco particles neutralize each other.

Figures 5A, 5B:
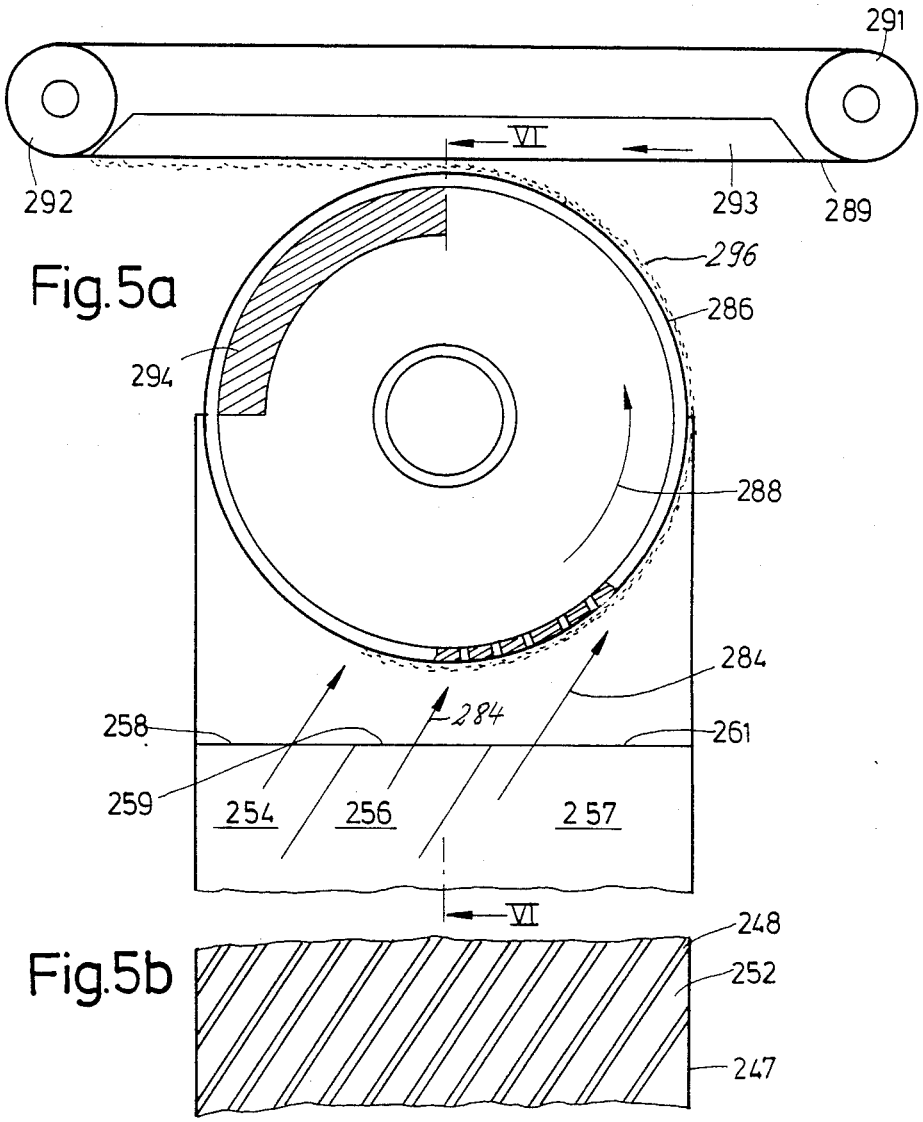
FIG. 5*a* is a fragmentary vertical sectional view of a third distributor wherein the conveyor which receives particles of tobacco to form a homogeneous stream is a disc-shaped rotary member.
FIG. 5*b* is a view similar to that of FIG. 3*b* but showing a portion of a nozzle for admission of streams of compressed air into a distributor which embodies the structure of FIG. 5*a;*
Figure 7:
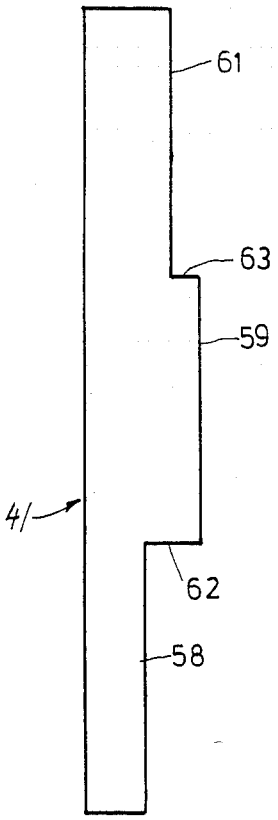
FIG. 7 is a plan view of the tobacco discharging end of tobacco supplying means in the distributor of FIG. 1, substantially as seen in the direction of arrows from the line VII—VII of FIG. 2.

FIGS. 5*a*, 5*b* and 6 illustrate a portion of a third apparatus wherein all such parts which are identical with or clearly analogous to the corresponding parts of the apparatus of FIGS. 1, 2, 3*a*, 3*b* and 7 to 11 are denoted by similar reference characters plus 200. The band-like air-permeable conveyor 51 is replaced with a disc- or wheel-shaped rotary conveyor 286 including an air-permeable circumferentially extending element or wall 273 having radially extending openings 272 communicating with a suction chamber 276 in the interior of the conveyor 286. The channel 287 is a circumferentially complete channel which surrounds the air-permeable element 273 and is flanked by two flanges 264, 266 performing the functions of the aforediscussed sidewalls 64, 66. The guide wall 241 defines an arcuate path for the admission of partial streams 281, 282, 283 of tobacco particles into the channel 287 whereby such partial streams travel first along the guide faces 254, 256, 257 and thereupon beyond the edge faces 258, 259, 261 at the outlet end of the aforementioned arcuate path. The orientation of the guide faces 254, 256, 257 is such that each stream of compressed air flowing along the arcuate path at the concave side of the guide wall 241 flows in the direction which is indicated by arrows 284, i.e., it has a component of movement in the direction of travel of the homogeneous tobacco stream which grows at and thereupon advances with the outer side of the circumferentially extending element 273 of the conveyor 286. The direction of travel of the tobacco stream with the conveyor 286 is indicated by the arrow 288.

The conveyor 286 delivers successive increments of the fully grown homogeneous tobacco stream 296 to the underside of the lower reach of an air-permeable endless belt conveyor 289 which is trained over pulleys 291, 292 and cooperates with a suction chamber 293 having an open or partially open bottom wall adjacent to the upper side of the lower reach of the conveyor 289. A stationary shroud 294 in the interior of the conveyor 286 overlies the inner ends of the openings 272 in the element 273 between the nine and twelve o'clock positions of the conveyor 286, as viewed in FIG. 5*a*, to ensure that the suction chamber 293 can readily attract successive increments of the tobacco stream 296 from the outer side of the element 273 to the underside of the lower reach of the conveyor 289. The surplus of air which the nozzle (not shown) admits into the channel 287 is permitted to escape through a narrow clearance 297 between the flange 264 and the adjacent outwardly extending upper end portion of the guide wall 241. The annular channel 287 communicates with the channel 267 which is located to the right of the uppermost portion of the guide wall 241, as viewed in FIG. 6; in fact, the annular channel 287 can be said to form part of the channel 267.

FIG. 6 further shows that the guide wall 241 need not cooperate with a carded conveyor, such as the conveyor 37 of FIG. 2.

The fact that the path which is defined by the outer side of the circumferentially extending element 273 of the conveyor 286 is an arcuate (convex) path is of no consequence insofar as the formation of a homogenized tobacco stream is concerned. Thus, the inclination of air streams flowing in the directions indicated by arrows 284 can be readily selected in such a way that the slippage of particles which impinge upon the external surface of the rotating element 273 and/or upon the tobacco particles which are already held at the external surface of such element (while the conveyor rotates in the direction of arrow 288) is nil or negligible. FIG. 5*a* shows that the particles of tobacco which advance in the directions indicated by arrows 284 (especially those advancing beyond the edge face 261) impinge substantially tangentially upon the element 273 so that they are not likely to rebound at the outer side of such element.

The distribution of openings 272 in the element 273 can be readily selected in such a way that the effect is the same as that described in connection with FIGS. 8 to 11. It is also possible to provide the element 273 with uniformly distributed openings 272 and to place at the inner side of the element 273 a stationary valving element (such as a strip having perforations distributed in a manner as shown for the openings 72 in the bottom wall 73 of FIG. 8) which ensures more pronounced and less pronounced attraction of tobacco particles to selected portions of the outer side of the element 273.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for building a continuous tobacco stream in the distributor of a filler forming machine, comprising a conveyor including an air-permeable tobacco advancing element arranged to move in a predetermined direction and having a first side and a second side; suction generating means adjacent to the first side of said element; first and second sidewalls adjacent to the second side of and defining with said element an elongated channel extending in said direction; a source of tobacco particles; a source of compressed air; and means for feeding tobacco particles to said conveyor, comprising means for supplying particles of tobacco from the respective source along an arcuate path and into said channel so that the particles advance toward and adhere to the second side of said element under the action of said suction generating means, and means for admitting into said arcuate path streams of compressed air from the respective source in substantial parallelism with said arcuate path so that the compressed air entrains the particles of tobacco by conveying such particles along said path, each such stream of compressed air being inclined with reference to and having s component of movement in said direction to thus compel the particles of tobacco in said channel to advance toward the second side of said element while simultaneously advancing in said direction before the articles reach said element.

2. The apparatus of claim 1, wherein said supplying means includes a third wall which merges gradually into one of said sidewalls at a location which is remote from said element.

3. The apparatus of claim 1, wherein said source of compressed air comprises a plenum chamber and a blower having a pressure side connected with said plenum chamber.

4. The apparatus of claim 1, wherein said arcuate path has an outlet portion communicating with and an inlet portion remote from said channel, said admitting means including a nozzle arranged to admit streams of compressed air into the inlet portion of said path.

5. The apparatus of claim 1, wherein said supplying means has an outlet portion and a plurality of edge faces at said outlet portion, the particles of tobacco being arranged to advance beyond said edge faces and toward the second side of said element and said edge faces being staggered with reference to each other, as considered transversely of said direction.

6. The apparatus of claim 5, wherein said supplying means further comprises a guide face for each of said edge faces, said guide faces extending toward and terminating at the respective edge faces.

7. The apparatus of claim 5, wherein at least one of said sidewalls has an air-permeable portion disposed intermediate said edge faces and the second side of said element to permit escape of some air from said channel by way of said permeable portion.

8. The apparatus of claim 7, wherein said permeable portion is spaced apart from said edge faces, as considered transversely of said direction, so that air which flows through said permeable portion undergoes a pronounced change in the direction of flow.

9. The apparatus of claim 7, further comprising a suction generating device outwardly adjacent to the air-permeable portion of said one sidewall to draw air from said channel and to thus reduce the quantity of air that enters said suction generating means by passing through the air-permeable element of said conveyor.

10. The apparatus of claim 9, wherein said suction generating device comprises a suction chamber communicating with said channel by way of said air-permeable portion and a blower having a suction side connected with said suction chamber.

11. The apparatus of claim 1, wherein said conveyor includes an endless band having an elongated reach which constitutes said air-permeable element.

12. The apparatus of claim 1, wherein said channel is disposed at a level below the air-permeable element of said conveyor.

13. The apparatus of claim 1, wherein said path has an inlet remote from and an outlet in communication with said channel, the distance between said outlet and said element constituting a fraction of the distance between said inlet and said outlet.

14. Apparatus for building a continuous tobacco stream in the distributor of a filler forming machine, comprising a conveyor including an air-permeable tobacco advancing element arranged to move in a predetermined direction and having a first side and a second side; suction generating means adjacent to the first side of said element, first and second sidewalls adjacent to the second side of and defining with said element an elongated channel extending in said direction; a source of tobacco particles; a source of compressed air comprising a plenum chamber; and means for feeding tobacco particles to said conveyor, comprising means for supplying particles of tobacco from the respective source along an arcuate path and into said channel so that the particles advance toward and adhere to the second side of said element under the action of said suction generating means, said arcuate path having an outlet portion communicating with and an inlet portion remote from said channel, and means for admitting into said arcuate path streams of compressed air from the respective source so that each such stream is inclined with reference to and has a component of movement in said direction to thus compel the particles of tobacco in said channel to advance toward the second side of said element while simultaneously advancing in said direction before the particles reach said element, said admitting means including a nozzle arranged to admit streams of compressed air into the inlet portion of said path and said admitting means further including vanes subdividing the interior of said nozzle into a plurality of passages each of which is inclined with reference to said direction and each of which is arranged to convey a stream of compressed air from said plenum chamber into said path, said nozzle having an arcuate cover whose curvature substantially matches that of said path and said cover overlying said passages.

15. The apparatus of claim 14, wherein said cover has a convex side facing said passages.

16. Apparatus for building a continuous tobacco stream in the distributor of a filler forming machine, comprising a conveyor including an air-permeable tobacco advancing element arranged to move in a predetermined direction and having a first side and a second side; suction generating means adjacent to the first side of said element; first and second sidewalls adjacent to the second side of and defining with said element an elongated channel extending in said direction, the second side of said element having two marginal portions each adjacent to a different one of said sidewalls and a central portion between such marginal portions; a source of tobacco particles; a source of compressed air; and means for feeding tobacco particles to said conveyor, comprising means for supplying particles of tobacco from the respective source along an arcuate path and into said channel so that the particles advance toward and adhere to the second side of said element under the action of said suction generating means, and means for admitting into said arcuate path streams of compressed air from the respective source so that each such stream is inclined with reference to and has a component of movement in said direction to thus compel the particles of tobacco in said channel to advance toward the second side of said element while simultaneously advancing in said direction before the particles reach said element, said supplying means having an outlet portion and a plurality of edge faces at said outlet portion, the particles of tobacco being arranged to advance beyond said edge faces and toward the second side of said element and said edge faces being staggered with reference to each other, as considered transversely of said direction, said supplying means further comprising a guide face for each of said edge faces and said guide faces extending toward and terminating at the respective edge faces, the orientation of said guide faces being such that two thereof direct tobacco particles toward different ones of said marginal portions and a third thereof directs tobacco particles toward the central portion of said second side.

17. Apparatus for building a continuous tobacco stream in the distributor of a filler forming machine, comprising a conveyor including an air-permeable tobacco advancing element arranged to move in a predetermined direction and having a first side and a second side; suction generating means adjacent to the first side of said element; first and second sidewalls adjacent to the second side of and defining with said element an elongated channel extending in said direction; a source of tobacco particles; a source of compressed air; and means for feeding tobacco particles to said conveyor, comprising means for supplying particles to tobacco from the respective source along an arcuate path and into said channel so that the particles advance toward and adhere to the second side of said element under the action of said suction generating means, and means for admitting into said arcuate path streams of compressed air from the respective source so that each such stream is inclined with reference to and has a component of movement in said direction to thus compel the particles of tobacco in said channel to advance toward the second side of said element while simultaneously advancing in said direction before the particles reach said element, said supplying means having an outlet portion and a plurality of edge faces at said outlet portion, the particles of tobacco being arranged to advance beyond said edge faces and toward the second side of said element and said edge faces being staggered with reference to each other, as considered transversely of said direction, said supplying means further comprising a guide face for each of said edges faces and said guide faces extending toward and terminating at the respective edge faces, said supplying means further comprising an additional surface between each pair of neighboring guide faces and each of said additional surfaces being inclined with reference to said direction through an angle at least approximately the angle of inclination of the air streams with reference to said direction.

18. Apparatus for building a continuous tobacco stream in the distributor of a filler forming machine, comprising a conveyor including an air-permeable tobacco advancing element arranged to move in a predetermined direction and having a first side and a second side, said conveyor comprising a rotary disc having a circumferentially extending wall which constitutes said air-permeable element; suction generating means adjacent to the first side of said element; first and second sidewalls adjacent to the second side of and defining with said element an elongated channel extending in said direction; a source of tobacco particles; a source of compressed air; and means for feeding tobacco particles to said conveyor, comprising means for supplying particles of tobacco from the respective source along an arcuate path and into said channel so that the particles advance toward and adhere to the second side of said element under the action of said suction generating means, and means for admitting into said arcuate path streams of compressed air from the respective source so that each such stream is inclined with reference to and has a component of movement in said direction to thus compel the particles of tobacco in said channel to advance toward the second side of said element while simultaneously advancing in said direction before the particles reach said element.

19. The apparatus of claim 18, further comprising a second conveyor including an endless air-permeable band having an elongated reach, said reach having a first side adjacent to a portion of said element and a second side and further comprising a suction chamber adjacent to the second side of said reach to draw tobacco particles from the second side of said circumferentially extending wall.

20. Apparatus for building a continuous tobacco stream in the distributor of a filler forming machine, comprising a conveyor including an air-permeable tobacco advancing element arranged to move in a predetermined direction and having a first side and a second side; suction generating means adjacent to the first side of said element and including portions having different permeabilities; first and second sidewalls adjacent to the second side of and defining with said element an elongated channel extending in said direction; a source of tobacco particles; a source of compressed air; and means for feeding tobacco particles to said conveyor, comprising means for supplying particles of tobacco from the respective source along an arcuate path and into said channel so that the particles advance toward and adhere to the second side of said element under the action of said suction generating means, and means for admitting into said arcuate path streams of compressed air from the respective source so that each such stream is inclined with reference to and has a component of movement in said direction to thus compel the particles of tobacco in said channel to advance toward the second side of said element while simultaneously advancing in said direction before the particles reach said element.

* * * * *